US010087546B2

(12) United States Patent
Arvin et al.

(10) Patent No.: US 10,087,546 B2
(45) Date of Patent: Oct. 2, 2018

(54) PREVENT AND REMOVE ORGANICS FROM RESERVOIR WELLS

(71) Applicant: International Business Machines Corporation, Armonk, NY (US)

(72) Inventors: Charles L. Arvin, Savannah, GA (US); Glen N. Biggs, Wappingers Falls, NY (US); Phillip W. Palmatier, Hopewell Junction, NY (US); Joseph C. Sorbello, Wappingers Falls, NY (US); Tracy A. Tong, Wallkill, NY (US); Freddie Torres, Beacon, NY (US)

(73) Assignee: International Business Machines Corporation, Armonk, NY (US)

( * ) Notice: Subject to any disclaimer, the term of this patent is extended or adjusted under 35 U.S.C. 154(b) by 466 days.

(21) Appl. No.: 14/523,061

(22) Filed: Oct. 24, 2014

(65) Prior Publication Data

US 2016/0115617 A1 Apr. 28, 2016

(51) Int. Cl.

| | |
|---|---|
| ***C25D 21/14*** | (2006.01) |
| ***C25D 17/00*** | (2006.01) |
| ***C25D 21/18*** | (2006.01) |
| ***C25D 17/02*** | (2006.01) |
| ***C25D 21/08*** | (2006.01) |
| ***C25D 21/10*** | (2006.01) |

(52) U.S. Cl.

CPC ..... *C25D 21/18* (2013.01); *C25D 17/02* (2013.01); *C25D 21/08* (2013.01); *C25D 21/10* (2013.01)

(58) Field of Classification Search

CPC ..... C25D 17/02; C25D 21/10; C25D 21/14; C25D 17/00

USPC ..... 204/275.1

See application file for complete search history.

(56) References Cited

U.S. PATENT DOCUMENTS

| | | | | |
|---|---|---|---|---|
| 3,383,294 A * | 5/1968 | Wood | C25C 3/36 204/245 |
| 4,253,916 A * | 3/1981 | Kobayashi | C25D 17/18 205/145 |
| 2013/0284604 A1 | 10/2013 | Spurlin et al. | |
| 2013/0313123 A1 | 11/2013 | Abraham et al. | |
| 2014/0097091 A1 | 4/2014 | Deligianni et al. | |

FOREIGN PATENT DOCUMENTS

JP 2009507221 A 2/2009

* cited by examiner

*Primary Examiner* — Zulmariam Mendez

(74) *Attorney, Agent, or Firm* — Scully, Scott, Murphy & Presser, P.C.; Steven J. Meyers

(57) ABSTRACT

Plating bath and well structures and methods are described to stop the organic compounds present in plating reservoir wells or bath solution from rising, i.e., climbing up the reservoir wall. An electroplating apparatus includes a vessel holding a liquid solution including metal plating material and an organic species, and a method of operating an electroplating apparatus. The apparatus is designed with plating bath and structures and methods to stop the organic compounds present in plating reservoir wells or bath solution from rising, i.e., climbing or wicking up the inner surfaces of reservoir walls, and to wash them back down on a continuous or cyclical basis in order to maintain a concentration of organic compounds in the plating solution within upper and lower specification limits.

8 Claims, 5 Drawing Sheets

PREVENT AND REMOVE ORGANICS FROM RESERVOIR WELLS

FIELD

This disclosure relates to an electroplating apparatus including liquid solutions for plating metals or alloys on workpieces, and systems and method of operating an electroplating apparatus to prevent organic compounds in the liquid solutions from rising, i.e., "walking up" the side of a plating reservoir or vessel.

BACKGROUND

In the electronics industry, a majority of "wet processes" such as electroplating, use chemical baths having chemical species therein to interact with a workpiece or object placed in the bath, e.g., to change the workpiece surface such as adding a film or plate to the workpiece surface. For example, semiconductor wafers are deposited in reservoir baths or wells containing a metal solution such as Nickel (Ni) or an alloy such as solder.

These Ni (or other) metal solutions in the chemical baths often include wetting agents, e.g., organic compound additives that may affect several properties of the nickel deposit, e.g., prevent pore formation, prevent electrophoretic deposition of impurities on the surfaces, etc.

In the case of Nickel plating baths, the tooling is designed to avoid excessive generation of Ni vapor phase chemistry as per Environmental Protection Agency. Thus, a known concentration of surfactants, e.g., wetting agents (referred to herein as "organics"), is used in the Ni plating chemistry to meet Environmental Protection Agency requirements. Current techniques perform "blind" additions of the minimum wetting agents (i.e., added to plating chemistry such as a surfactant, e.g., Triton™ X-100 (Trademark of the Dow Chemical Company) to meet EPA requirements. If a minimum is 0.1 ml per liter and (surfactant) is required, it is important that the wetting agents do not leave or escape the plating bath or solution.

However, it has been found that the organic chemical species present in plating bath solutions have a tendency to rise, i.e., "walk up" or "climb", the side of the reservoir well or bath structure, e.g., to a location above the liquid level line. Further, it has been observed that, over time, the organics tend to wash back down into the plating chemistry leading to excess organics in the bath. For a nickel (Ni) plating bath, the concentration of organic compounds such as wetting agents may increase from 0.4 mL/L to 1.5 mL/L when the bath level rose in the reservoir. Given an upper specification limit for wetting agent concentration in the bath at 0.9 mL/L. would lead to a down time on the tool for an extended period, e.g., 1 week, while the organics were slowly removed using dummy plating and dilution.

While a current option exists to use dummy plating that would consume a small amount of the organics and dilute the bath until the concentration was reduced below the upper specification limit, this does not address the fundamental problem of eliminating the climbing of organics up the reservoir wall and leaving the plating chemistry.

SUMMARY

Plating bath and well structures and methods are described to stop the organic compounds present in plating reservoir wells or bath solution from rising, i.e., climbing up the reservoir wall, and to wash them back down on a continuous basis in order to maintain a concentration of organic compounds in the plating solution within upper and lower specification limits.

In one aspect, the plating bath and well structures provide for the formation of a liquid flow down the walls of the reservoir to wash back into solution without diluting the plating bath.

In a further aspect, the plating bath and vessel wall structures are modified to eliminate climbing of organics.

In one aspect, there is provided an electroplating apparatus. The electroplating apparatus comprises a vessel having walls configured to hold a liquid solution of a metal plating material and including an organic species, the liquid solution contained within the vessel at a first level below a top rim of the vessel; and a means for preventing an organic species of the solution from wicking up inner wall surfaces of the vessel toward the top rim.

In a first embodiment, the vessel top rim defines a vessel perimeter. The preventing means comprises: a source of the metal plating solution; a conveying apparatus for providing the liquid solution from the source to a height at or above the top rim, the conveyance apparatus having a portion aligned with the vessel perimeter at the height, an opening formed in the aligned conveyance portion to create a flow of the metal plating solution over the top rim and on an inner wall surface, the solution flow of a force suitable to rinse the organics back into the tank, wherein a relative concentration of organic species in the liquid solution is maintained.

In one aspect, the conveyance apparatus comprises: a pipe including a pipe portion in the alignment with the vessel perimeter at the height, the pipe portion including the opening; and a pump connected to the pipe for pumping liquid solution in the pipe through the opening.

In a further aspect, the conveyance apparatus comprises: a pipe including a nozzle bar portion at a height above or aligned with the vessel top rim and inwardly offset therefrom, the nozzle bar portion including a plurality of nozzle openings; and a pump connected to the pipe for pumping liquid solution through the plurality of nozzle openings, the plurality of nozzle openings directed to create a downward flow of the liquid solution at or below the top rim on each inner wall surface.

In further aspect, there is provided an electroplating apparatus. The electroplating apparatus comprises: a vessel having an inner wall and an outer wall defining a space therebetween, the inner wall configured to hold a liquid solution of a metal plating material and including an organic species, the liquid solution contained within the vessel at a first level below a top rim of the vessel; an opening formed in the inner wall surface below a top rim of the vessel; and a source for providing liquid solution in the defined space, wherein the liquid solution from the source exits the formed opening to create a flow of the liquid solution over the inner wall and on each inner wall surface, the solution flow of a force suitable to rinse the organics back into the tank, wherein a relative concentration of organic species in the liquid solution is maintained.

In a further embodiment, there is provided a method for operating an electroplating vessel. The vessel has walls configured to hold a liquid solution of a metal plating material and including an organic species, the liquid solution contained within the vessel at a first level below a top rim of the vessel, wherein when a workpiece is immersed in the liquid solution to displace a volume of the liquid solution resulting in the liquid solution level rising within the vessel to a second level above the first level. The method comprises: after immersing the workpiece, immersing an object in the liquid solution contained in the vessel; the object when immersed causing displacement of a volume of the liquid solution resulting in the liquid solution level rising within the vessel to the second level; and removing the object from the liquid solution, wherein when the object is removed, the liquid level is lowered to the first level while simultaneously washing the organics back into the solution.

BRIEF DESCRIPTION OF THE DRAWINGS

These and other objects, features and advantages of the present invention will become apparent from the following detailed description of illustrative embodiments thereof, which is to be read in connection with the accompanying drawings, in which.

DETAILED DESCRIPTION

Figure 1:
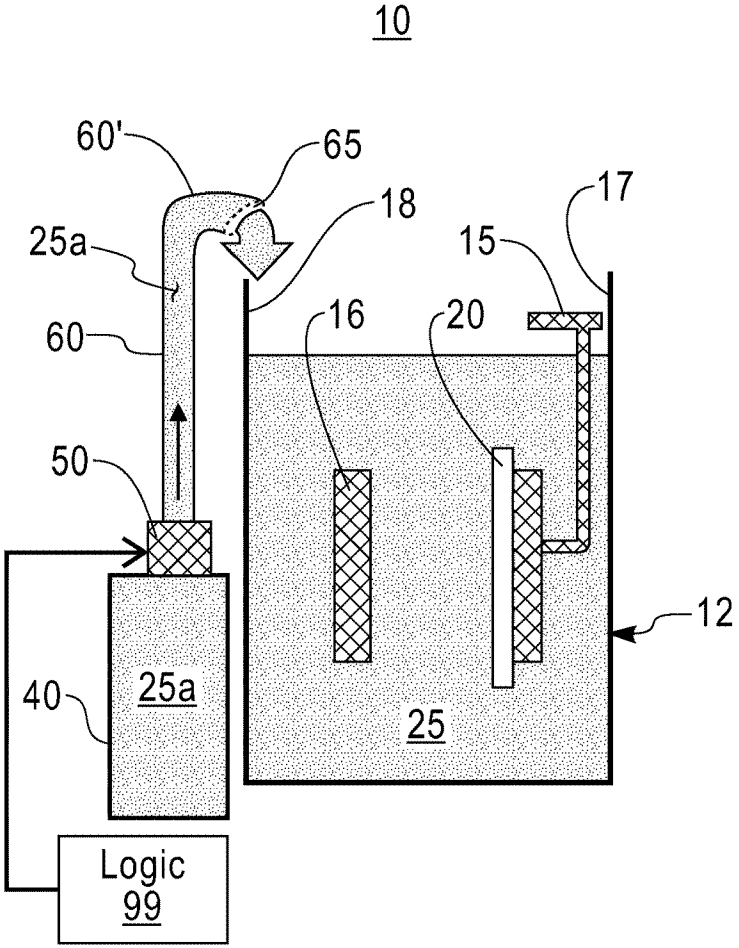
FIG. 1 depicts a first embodiment of an electroplating apparatus configured to prevent migration of organic species up inner wall surfaces of a vessel.

FIG. 1 illustrates a diagrammatical cross-sectional view of an example electroplating (or electrodepositing) apparatus 10 according to one embodiment. In the description herein, for electroplating applications, an electroplating bath includes a liquid solution 25 that may be aqueous, and contain one or more chemicals or chemical species. These chemical species exist in certain concentrations in the solution. Some of these species interact or chemically react with a material or object, called a "workpiece", which is placed in the bath, e.g., to add a film to a workpiece surface.

Figure 2:
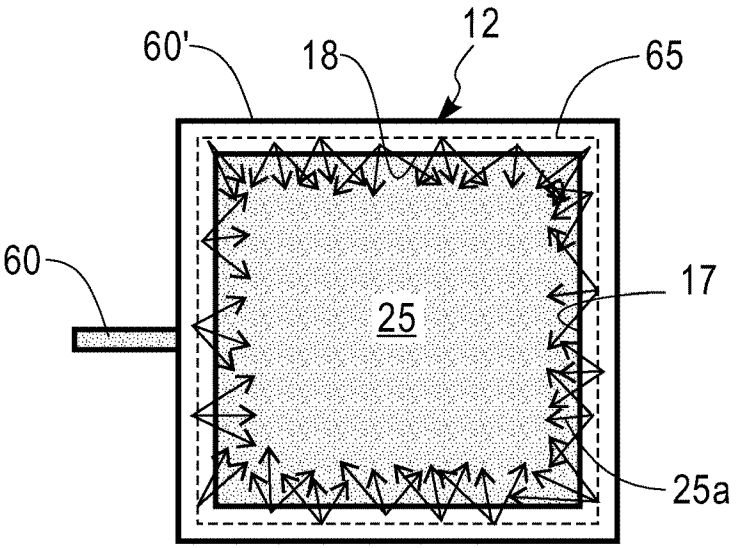
FIG. 2 shows a top down view of the top of the electroplating apparatus of FIG. 1 according to the first embodiment.

For electroplating applications, the apparatus includes a plating vessel 12 (alternately referred to herein as a reservoir, container, or tank), e.g., an open box shape, that contains the bath 25 (liquid plating solution) forming an electroplating cell. A holding fixture 15 may be used to hold the article to be plated. In one embodiment, the article or workpiece is a semiconductor wafer 20. The article to be plated, i.e., the wafer 20, comprises the cathode (e.g., a negative electrode) in the electrolysis cell through which a direct electric current is passed. In another embodiment, the cathode is a separate element. The anode 16 is usually a bar of the metal being plated and is shown in the vessel below and separated from the wafer within the plating bath 25. While the workpiece (e.g., cathode) and the anode are shown in a vertical orientation within the cell in FIG. 1, it is understood that alternative embodiment may be employed where the both workpiece (e.g., cathode) and the anode are situated in a horizontal orientation within the plating vessel 12. Moreover, as shown in FIG. 2, the aqueous solution vessel or container 12 may be a square or rectangular shaped container, or may be round such as a circular or elliptical shaped.

As known, the plating bath solution 25 serves as a conductive medium and utilizes a low direct current (d.c.) voltage. The wafer 20 that is to be plated is submerged into the plating bath 25 and a low voltage d.c. current is applied to the bath. In one embodiment, during electroplating process, via electrolysis, metal becomes deposited on to the workpiece (wafer) and metal from the anode bar 16 dissolves. An external circuit (not shown) consisting of a source of direct current (d.c.), conveys this current to the plating vessel, and associated instruments such as ammeters, voltmeters, and voltage regulators maintain current at the appropriate values. A power source including a rectifier may be used to convert alternating current (a.c.) power to a carefully regulated low voltage d.c. current. Other embodiments for providing electrical energy for the plating process would be known.

In one embodiment, the plating bath well or reservoir wall structure 12 may be a polymer and is used in systems for plating fabricated semiconductor wafers and or wafer substrates 20 with a chemical species that include metals, e.g., Nickel, or alloys thereof such as solder, and other organic compounds (organic species) such as wetting agents. A minimum concentration of the surfactant is required in solution 25, and moreover, it is required that the surfactant concentration be maintained below an upper limit specification. Over time, the organic compounds (surfactant) present in the plating reservoir bath solutions 25 tend to rise, i.e., climb up, the inner surfaces of reservoir walls 17.

In one aspect of the disclosure, for Nickel plating applications, the apparatus 10 includes a control scheme for replenishing one or even several of the depleted or consumed chemical and organic species in the solution. Replenishment, in one embodiment, is used to keep the bath concentration of the escaped organics species from decreasing below a lower concentration limit and increasing beyond an upper concentration limit. In one embodiment, the control scheme is provided to control bath composition variation by preventing organic components in the bath from escaping, i.e., migrating upwards along the inner side walls 17 of the vessel 12.

In the control scheme depicted in the cross-sectional view of the apparatus 10 in FIG. 1, a source tank or reservoir 40 provides the solution 25*a* (metal plus surfactant in the desired chemistry). In one embodiment, a liquid flow of the solution 25*a* is provided from the top of the vessel 12 and down each inner side wall 17 of the tank or vessel 12 at times in between workpiece electroplating immersions. In a non-limiting embodiment, a liquid pump 50 and a conveyance or piping apparatus 60 operatively connected to the source tank 40 cooperate under logic control by a programmed processor or equivalent logic controller circuit 99, to feed liquid solution 25*a* over the top rim 18 of the vessel and down each inner sidewall surface. As further shown in the top down conceptual view of FIG. 2, the conveyance or piping apparatus 60 includes a portion 60' that is configured along the vessel perimeter and aligned with the rim of the vessel. This portion 60' includes the opening 65, e.g., an orifice or slit or series thereof, to generate a cascading flow of the liquid solution 25*a* that is pumped in apparatus 60. The opening 65 in the conveyance apparatus 60 may be continuous to create a waterfall effect of solution 25*a* over the top rim or top edge 18 of the container 12 at a force suitable to effect a wash or rinse down of any organics which have migrated up the inner cell wall surface 17 from the top down, along and around the perimeter of the vessel 12 and back into the reservoir solution 25. The piping apparatus 60 may include any liquid feed or conveyance device that is materially compatible with the metal plating solution and organics for conveying the solution above the top rim to produce the cascading waterfall effect via the opening 65 down the inner wall surfaces of the vessel.

Figure 4:
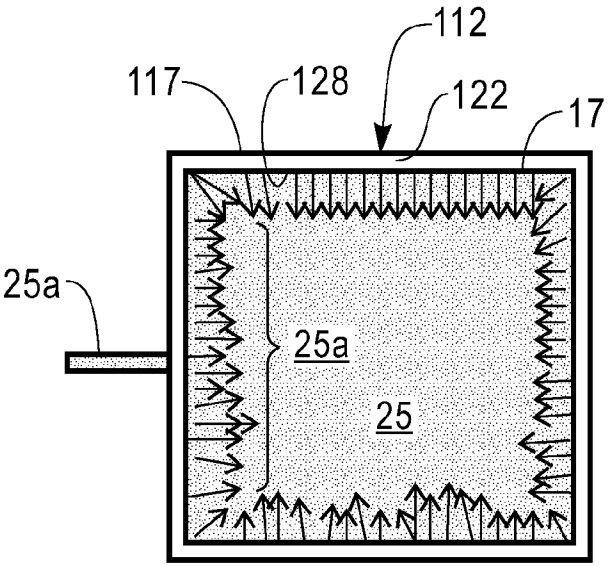
FIG. 4 shows a top down view of the top of the electroplating apparatus of FIG. 3 according to the second embodiment.
Figure 3:
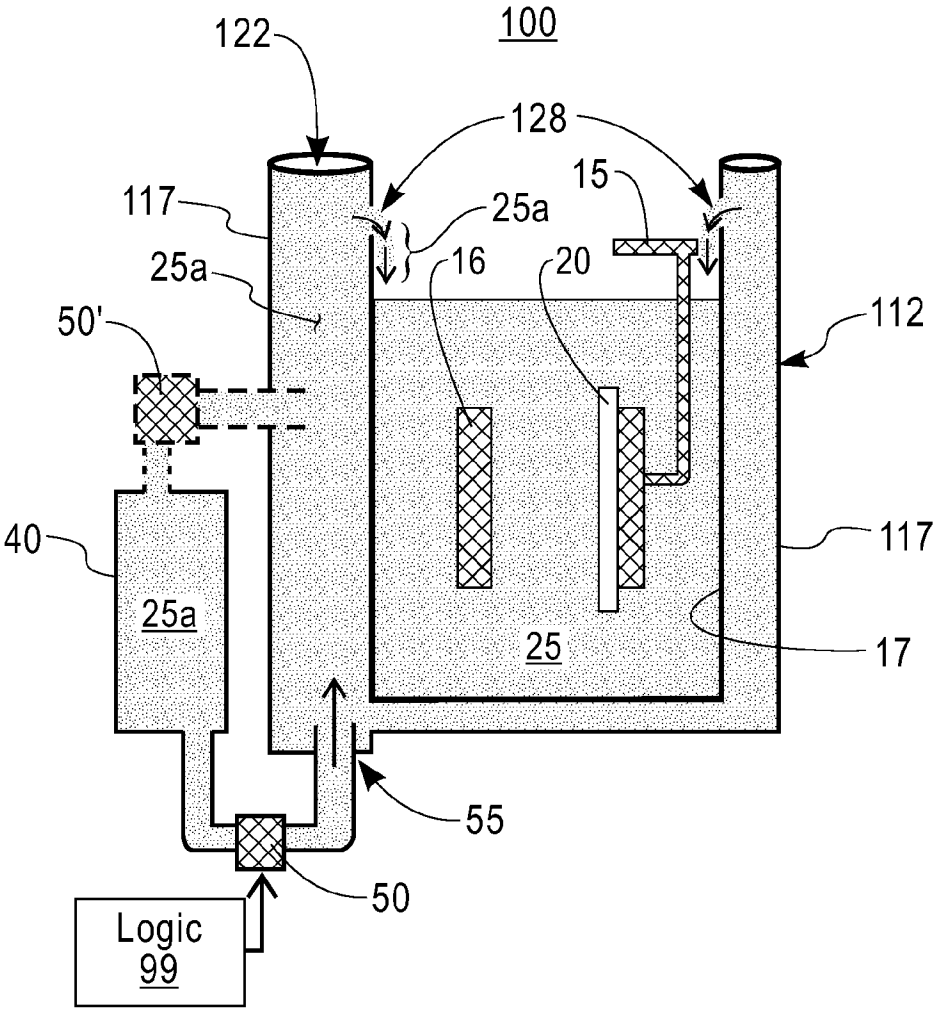
FIG. 3 depicts a second embodiment of an electroplating apparatus configured to prevent migration of organic species up inner wall surfaces of a vessel.

In a further embodiment in which liquid flow is provided down the inner side walls of the reservoir, an apparatus 100 is provided as shown in FIGS. 3 and 4, in which a cell 112 (a container) includes an inner wall 17 and outer wall 117 defining a seam or opening 122 there between in which the aqueous solution 25*a* is pumped. That is, a pumping apparatus including a source tank 40 of aqueous solution (metal plus surfactant in the desired chemistry) and a pump 50 (or 50'), connected at 55 to the formed seam or opening 122, under logic control by logic controller circuit 99, pumps the solution 25*a* within the seam 122 thereby allowing the liquid solution 25*a* to cascade through an opening 128 in the inner wall 17 provided around the perimeter near the top of the inner wall 17 of cell 112. The solution may be pumped at times in between workpiece electroplating immersions to effect a wash or rinse down of any organics which have migrated up the inner cell wall surface 17 from the top down, along and around the perimeter of the cell 112 and back into the reservoir solution 25. Alternately, the pumped solution 25*a* within the seam 122 circulates the liquid flow 25*a* over the top of the inner wall 17 which functions as a weir configured around the perimeter of the container 112.

Figure 6:
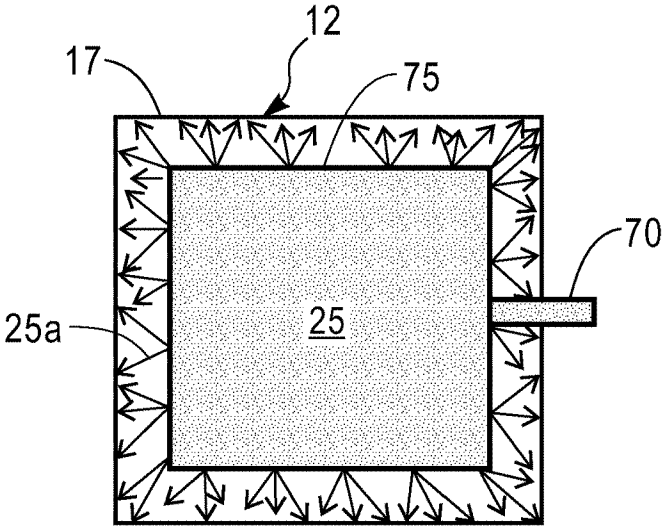
FIG. 6 shows a top down view of the top of the electroplating apparatus of FIG. 5 according to the third embodiment.
Figure 5:
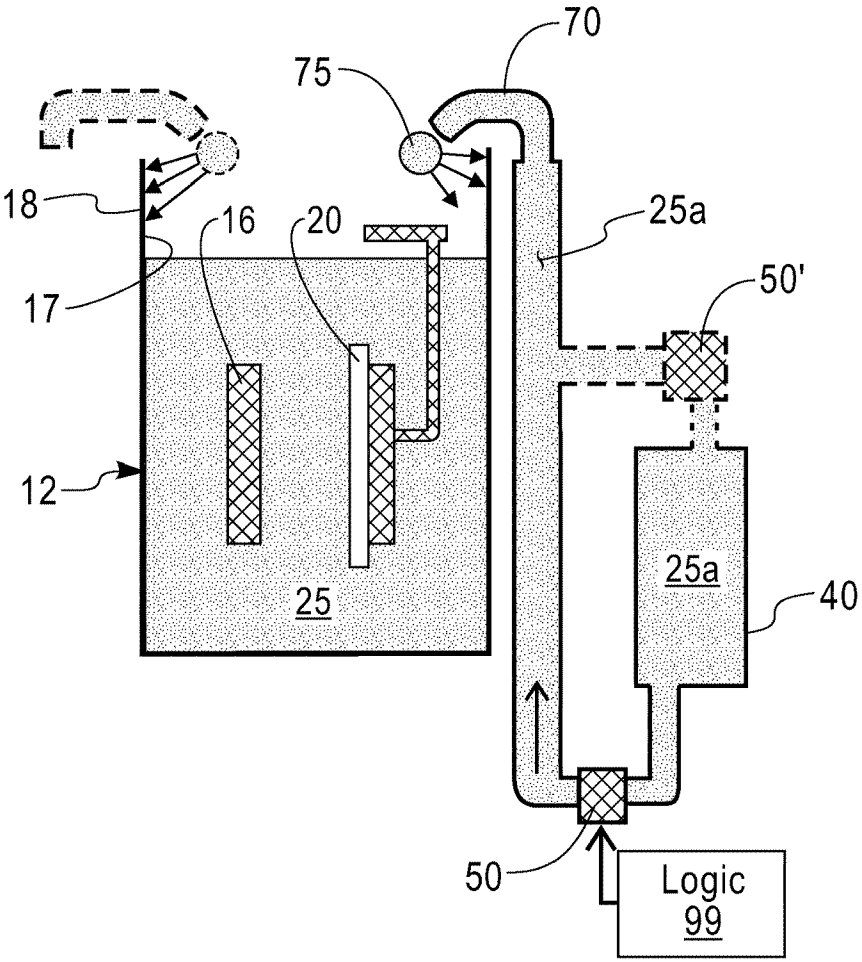
FIG. 5 depicts a third embodiment of an electroplating apparatus configured to prevent migration of organic species up inner wall surfaces of a vessel.

Similar to the first embodiment, an apparatus 200 is provided in which liquid flow is provided down the inner side walls of the container 12, as shown in FIGS. 5 and 6, by using a nozzle bar 75 provided to direct jets or spray of the liquid solution into the tank to rinse down the inner plating tank walls 17. In this embodiment, a source tank or reservoir 40 provides the liquid plating solution 25*a* (metal plus surfactant in the desired chemistry). A liquid flow of the solution 25*a* is provided via piping 70 and a fluid connecting nozzle bar 75 that is configured slightly inwardly offset from the outer perimeter of the top rim above or near the top of the container 12, as shown in FIG. 5. The nozzle bar portion 75 includes orifices such that liquid flow of the solution is provided down each inner side wall 17 of the tank or vessel 12. A liquid pump 50 (or 50'), under logic control by logic controller circuit 99, pumps the solution 25*a* through piping apparatus 70 and nozzle bar 75 configured around the top vessel perimeter as shown in FIG. 6, direct jets of the liquid solution 25*a* at approximately below the top rim or top edge 18 of the vessel 12 to effect a wash or rinse down of any organics which have migrated up the inner cell wall surface 17 from the top down, along and around the perimeter of the vessel 12 and back into the reservoir solution 25. In this embodiment, the pump and the nozzles of nozzle bar 75 must be maintained and carefully controlled to ensure the correct configuration of the jets of solution 25*a* to ensure the organics are washed down.

In a slight modification, the piping apparatus 70 and nozzle bar 75 may be incorporated into an opening within the tank wall, e.g., an opening formed by inner and outer wall. The nozzle bar may include a slit type of integral nozzle to release the liquid solution 25*a* back into the tank to rinse down the plating tank inner wall surfaces 17.

In the embodiments of FIGS. 1-6, a monitoring of the respective concentrations of organic species is performed. In one embodiment, there is a calculated an amount of organics in order to maintain the solution at the particular concentrations of organics species vs. metal plating species as desired. The use of pumps 50 can be operated with minimum control logic, e.g., On/Off logic, to thereby function as valves and ensure that the aqueous solution and concentrations of organic species therein lies between upper and lower limits and is maintained when operating at steady state, i.e., cyclic immersions of a same workpiece type.

Figure 7:
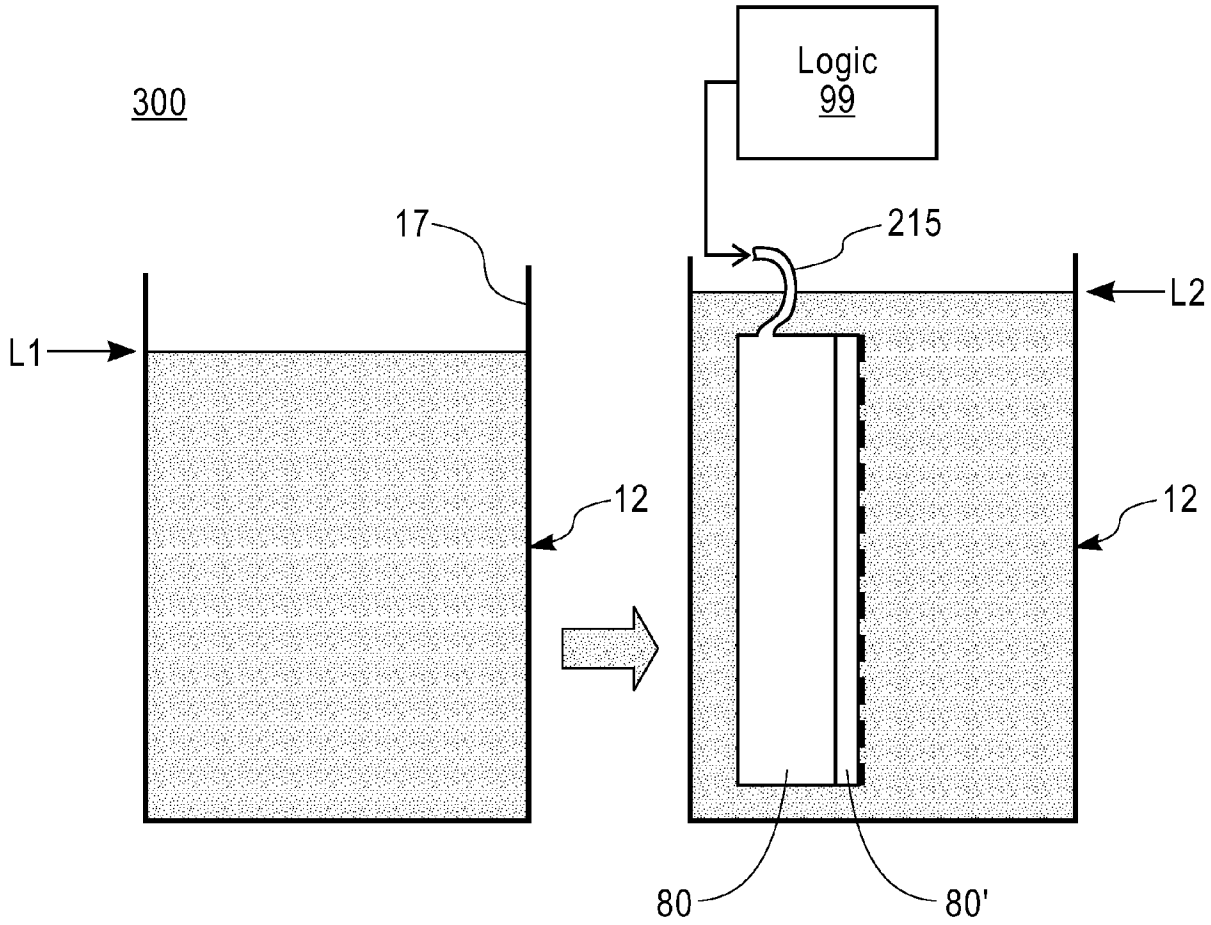
FIG. 7 depicts a fourth embodiment of an electroplating apparatus configured to prevent migration of organic species up inner wall surfaces of a vessel.

As an alternate embodiment, liquid organics may be washed down the sides via an increase in the liquid level in the tank. In this embodiment, as shown in FIG. 7, an apparatus 300 is provided that includes a bladder or physical displacement device 80 (e.g. a solid object) provided within the tank to add volume within the reservoir thereby raising the liquid level of plating chemistry to wash down organics that have climbed up the reservoir. For example, in FIG. 7, a tank 12 is provided with aqueous solution 25 showing a steady state level (L1) of the solution height in the reservoir without a workpiece immersion. As shown in the reservoir or tank 12, a workpiece submerged in the tank solution will displace the solution 25 to a second height level (L2) within the tank. It is understood that the level in which the organic species climb to would be greater than the level L2 within the tank (i.e., beyond the displaced volume level of the workpiece).

In the alternate embodiment of FIG. 7, the expandable bladder 80 is immersed within the solution within the container 12 and a bellows (not shown) is provided to push air into the bladder to increase the volume of the bladder and modulate the displacement volume of the solution. Use of a bellows to expand the bladder 80 to an expanded configuration 80' displaces the liquid and increases the height of the liquid level up the inner side wall equivalent to the height (L2) that an immersed workpiece itself would displace, e.g., level L2, as shown in FIG. 7, under steady state operating conditions. Use of the bladder 80 or like physical displacement device to modulate volume within the reservoir and raise and lower the liquid level of plating chemistry washes down organics that have climbed at least up to level L2 as an immersed workpiece would displace.

In one embodiment, a control or logic device (e.g., including a programmed hardware processor or like controller) 99, in cooperation with the timing of the immersion of the workpiece to be electroplated within the solution, is provided to control the timing of the immersion and/or expansion of the bladder and/or the amount of expansion of the bladder when immersed in the reservoir. That is, under logic device 99 control, in one embodiment, after a workpiece is immersed in the reservoir during electroplating and removed from the reservoir, the bladder 80 is then placed in the reservoir and actuated to modulate the displacement volume, i.e., cause the liquid solution level to rise to the point of liquid displacement, e.g., at level L2, and lower to wash the organics back into the solution. After displacement of the bladder 80 to wash down the organics, the bladder is removed from the reservoir. Under logic control, a steady state cycle is attained including repeated steps of workpiece immersion, electroplating, and removal and subsequent steps of immersion and volume displacement of the bladder. In one example, a steady state operation may include electroplating 300 workpieces, e.g., semiconductor wafers, in a day.

It is understood that the bladder 80 can be a balloon type structure or a solid object structure that can displace (modulate) the liquid solution volume in the tank under logic control in the manner as described. It is understood that the bladder/bellow must be materially compatible to not compromise the liquid metal plating solution and organic species included therein.

As mentioned, the volume that is displaced within the reservoir by the bladder (or object) should not be greater than the volume that a workpiece will displace when immersed in the reservoir in steady state. By controlling the volume to displace the solution to achieve the height L2 in between workpiece immersions, a proper concentration of organics is maintained without variation. However, this does not necessarily eliminate the walking of organics above the L2 height level, nor does it wash all organics back down, but it prevents an increase of organics concentration into the solution. To this end, in this embodiment, the concentration of organics in the liquid solution in the vessel is monitored and that amount of organics species must be increased to obtain the correct concentration of organics in a steady state operation condition due to the climbing. The logic can be used to configure out the correct concentration of organics to add back into the solution in this embodiment.

As mentioned, in the embodiments described with respect to FIGS. 1-7, the vessel 12 is of a material appropriate to the solution it contains. For electroplating metal, the walls of the container 12 are typically plastic, e.g., a polymer, or synthetic polymer such as polymethacrylate.

Figure 8A:
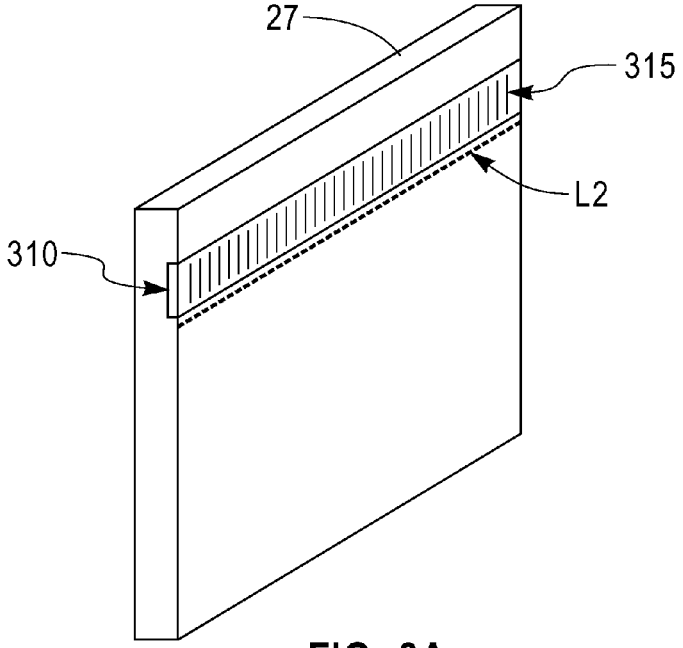
FIGS. 8A and 8B depict a wall portion of an electroplating apparatus vessel implementing a barrier material layer configured to prevent migration of organic species up the inner wall surface.

In a further embodiment for preventing organic species from climbing inner surface wall 20 of a reservoir, as shown in FIG. 8A, there is incorporated a barrier material lining 315, e.g., a glass lining, just at or above the displaced plating solution level height L2 representing the highest level that an immersed workpiece displaces the solution volume in the tank. The barrier material lining 315 prevents organic species in the solution from migrating up plating cell walls above this level. In this embodiment, a notch or groove 310 is cut into each wall 27 of the reservoir, and a barrier material 315 is embedded into the groove 310 to form barrier lining 315 such that the barrier material lining has a surface contiguous with an inner wall surface of the vessel. Barrier materials may include glass, glassy carbon, a ceramic, or any other material that does not allow wetting agent to wet.

Figure 8B:
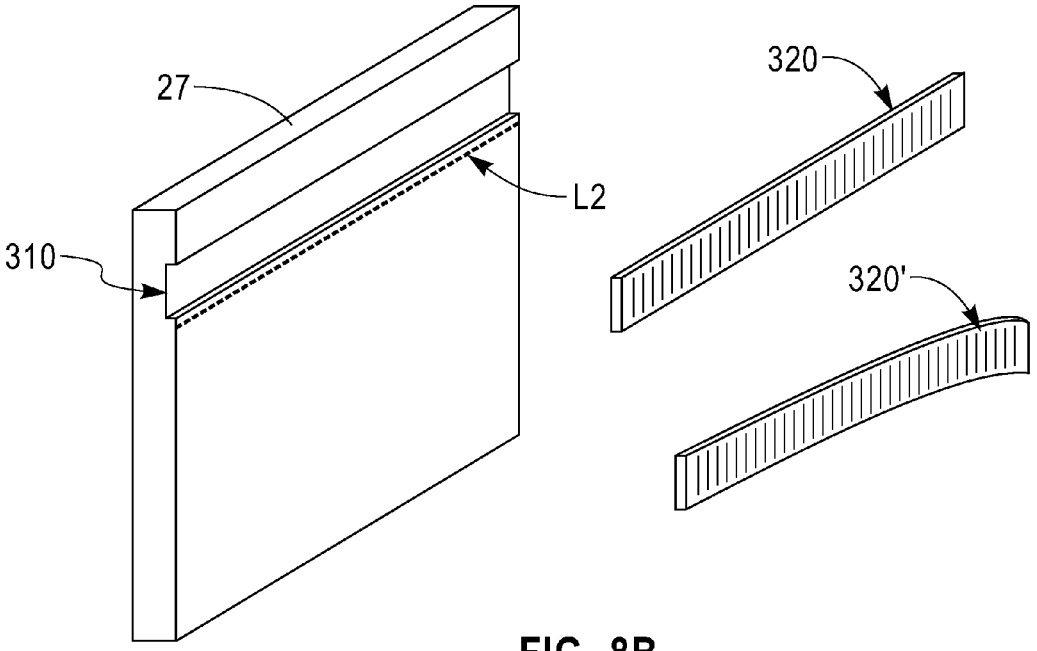

In an alternative embodiment, shown in FIG. 8B, a piece of flexible glass 320 may be attached, e.g., glued, or pressed into the notch 310 as the lining on the wall to prevent organics from rising. In this embodiment, a removable liner 320' is used as an assembled part of the tank which can be removed and either cleaned and reused or discarded.

In a further aspect, a combination of one or more the embodiments and structures shown herein with respect to FIGS. 1-8B may be used to eliminate the climbing of organics.

The structures and methods uncover the physical mechanism behind the problem of chemical escape/fluctuation in a plating solution bath. Thus, the structures and methods provided herein reduce workpiece product defects, and reduce any health hazard.

While the invention has been particularly shown and described with respect to illustrative and preformed embodiments thereof, it will be understood by those skilled in the art that the foregoing and other changes in form and details may be made therein without departing from the spirit and scope of the invention which should be limited only by the scope of the appended claims.

What is claimed is:

1. An electroplating apparatus comprising:

a vessel having walls configured to hold a liquid solution of a metal plating material and including an organic species, said liquid solution contained within said vessel at a first level below a top rim of said vessel; and a conveyance apparatus configured to provide a flow of added liquid solution down each inner sidewall of said vessel, wherein the flow of added liquid solution down each inner sidewall of said vessel prevents organic species from climbing said inner sidewalls of said vessel during electroplating, wherein said vessel top rim defines a vessel perimeter, and said conveyance apparatus comprises:

a conveyance portion configured along the vessel perimeter and aligned with said rim of said vessel, and an opening formed in said conveyance portion and aligned directly over a portion of a topmost surface of said rim of said vessel.

2. The electroplating apparatus of claim 1, wherein said opening formed in said conveyance portion is continuous along said perimeter.

3. The electroplating apparatus of claim2, wherein said opening is a slit or orifice.

4. The electroplating apparatus of claim 1, wherein said conveyance apparatus further comprises:

a pipe including said conveyance portion; and a pump connected to said pipe for pumping liquid solution in said pipe through said opening.

5. The electroplating apparatus of claim 1, wherein said conveyance apparatus is configured to provide a continuous flow of said added liquid solution to said vessel.

6. The electroplating apparatus of claim 1, wherein said vessel includes a holding fixture configured to hold a workpiece within a portion of said liquid solution in said vessel.

7. The electroplating apparatus of claim 1, wherein a source tank containing said added liquid solution and a pump are connected to an end portion of said conveyance apparatus, and said pump is configured to pump said added liquid solution from said source tank to said conveyance apparatus and into said vessel in a continuous manner.

8. The electroplating apparatus of claim 7, wherein said pump is controlled by a logic controller circuit.

* * * * *